US012638173B2

(12) United States Patent
Bijkerk et al.

(10) Patent No.: US 12,638,173 B2
(45) Date of Patent: May 26, 2026

(54) HYDROGEN GAS BURNER

(71) Applicant: AMF Den Boer B.V., Bunschoten-Spakenburg (NL)

(72) Inventors: Remco Bijkerk, Diepenveen (NL); Philip J. Domenicucci, Rockaway, NJ (US); René Henricus Sebastianus Vervoort, Hoevelaken (NL)

(73) Assignee: AMF DEN BOER B.V., Bunschoten-Spakenburg (NL)

( * ) Notice: Subject to any disclaimer, the term of this patent is extended or adjusted under 35 U.S.C. 154(b) by 0 days.

(21) Appl. No.: 18/812,132

(22) Filed: Aug. 22, 2024

(65) Prior Publication Data

US 2025/0067430 A1 Feb. 27, 2025

Related U.S. Application Data

(60) Provisional application No. 63/534,278, filed on Aug. 23, 2023.

(51) Int. Cl.
*F23D 14/22* (2006.01)
*F23C 3/00* (2006.01)
(Continued)

(52) U.S. Cl.
CPC ..... *F23D 14/22* (2013.01); *F23C 3/002* (2013.01); *F23N 5/24* (2013.01);
(Continued)

(58) Field of Classification Search
CPC .. F23D 14/22; F23D 2207/00; F23D 2212/20; F23D 14/58; F23D 14/10;
(Continued)

(56) References Cited

U.S. PATENT DOCUMENTS 619,274 A * 2/1899 Bush ..... F23D 14/10 122/23
1,497,954 A * 6/1924 Shaw ..... F23D 14/10 431/355
(Continued)

FOREIGN PATENT DOCUMENTS

DE 651540 C * 10/1937
FR 896738 A * 3/1945
(Continued)

OTHER PUBLICATIONS

International Search Report and Written Opinion issued on Jan. 8, 2025, in International Application No. PCT/IB2024/058189.
(Continued)

*Primary Examiner* — Michael G Hoang
*Assistant Examiner* — Logan P Jones
(74) *Attorney, Agent, or Firm* — Panitch Schwarze Belisario & Nadel LLP

(57) ABSTRACT

A hydrogen gas burner includes a first, axially extending, tubular pipe having an axial slot in a sidewall thereof. An axially elongate duct projects radially outwardly from the axial slot and is in fluid communication with an interior of the pipe. The axially elongate duct has through-holes formed through a wall thereof, communicating the interior of the pipe with an exterior thereof. A second, axially extending, tubular pipe, has an axial opening in a sidewall thereof, the axial opening spanning at least a portion of an axial extent of the second pipe. The first pipe is substantially nested within the second pipe and the axially elongate duct projects radially outwardly through the axial opening. A combination gas valve and pressure regulator fluidly connects hydrogen gas with the first pipe. An igniter ignites and initiates combustion of the hydrogen gas exiting from the first pipe and duct via the through-holes.

17 Claims, 10 Drawing Sheets

(51) Int. Cl.
*F23D 14/10* (2006.01)
*F23D 14/58* (2006.01)
*F23N 5/24* (2006.01)

(52) U.S. Cl.
CPC .. *F23C 2900/9901* (2013.01); *F23D 2207/00* (2013.01); *F23D 2212/20* (2013.01); *F23N 2229/00* (2020.01)

(58) Field of Classification Search
CPC .... F23C 3/002; F23C 2900/9901; F23N 5/24; F23N 2229/00
See application file for complete search history.

(56) References Cited

U.S. PATENT DOCUMENTS 1,820,493 A * 8/1931 Martin ..... F23D 14/10 431/355
1,916,983 A 7/1933 McKee
2,294,748 A 9/1942 Millard
2,494,243 A 1/1950 Houlis
2,707,519 A 5/1955 Strobel
2,807,320 A 9/1957 Wildermann
3,156,292 A * 11/1964 Ross ..... F23D 14/10 239/557
3,172,460 A 3/1965 Temple
3,469,791 A * 9/1969 Hartzell ..... F23D 14/10 431/350
4,421,474 A 12/1983 Meyer
4,465,455 A 8/1984 Meyer
4,702,693 A 10/1987 Fraioli
5,435,343 A 7/1995 Buezis
5,735,503 A 4/1998 Hietkamp
5,743,727 A * 4/1998 Rodgers ..... F23D 14/105 431/328
6,267,585 B1 7/2001 Suttrop
6,302,143 B1 10/2001 Sarlak
7,677,884 B2 3/2010 Kaupert et al.
8,669,499 B2 3/2014 Conrad
8,734,632 B1 5/2014 Eisman
8,840,942 B2 9/2014 Olver et al.
9,739,482 B2 8/2017 Colin et al.
10,066,838 B2 9/2018 Deng
10,208,958 B2 2/2019 Carroni et al.
10,627,107 B2 4/2020 Hirata et al.
10,648,662 B2 5/2020 Maitani et al.
11,428,405 B2 8/2022 Bijkerk et al.
2003/0213484 A1 11/2003 Alden et al.
2006/0032930 A1 2/2006 Glidden
2010/0024799 A1 2/2010 Conrad
2015/0245741 A1 9/2015 Fechter
2018/0119954 A1 5/2018 Fu
2018/0224122 A1 8/2018 Mimura
2018/0283686 A1* 10/2018 Bzowski ..... F23N 5/12
2019/0056107 A1 2/2019 Desai et al.
2019/0072273 A1 3/2019 Hirata et al.
2021/0239015 A1 8/2021 Brooker et al.
2021/0404655 A1* 12/2021 Bijkerk ..... F23D 14/02

FOREIGN PATENT DOCUMENTS

GB 638647 A * 6/1950
WO 2011062513 A1 5/2011
WO 2012143738 A2 10/2012
WO 2013024783 A1 2/2013
WO 2017136489 A1 8/2017
WO 2019032068 A2 2/2019
WO 2022003546 A1 1/2022

OTHER PUBLICATIONS

Int'l Search Report and Written Opinion issued Oct. 11, 2021 in Int'l Application No. PCT/IB2021/05579.

* cited by examiner

HYDROGEN GAS BURNER

CROSS-REFERENCE TO RELATED APPLICATION

This application claims priority from U.S. Provisional Patent Application No. 63/534,278, titled "Hydrogen Gas Burner", filed on Aug. 23, 2023, the entire contents of which are incorporated by reference herein.

BACKGROUND OF THE DISCLOSURE

The disclosure relates to a hydrogen gas burner for direct, indirect or hybrid fired ovens.

Conventional direct fired pipe ribbon burners for an oven, e.g., a commercial/industrial oven, generally operate on the combustion of natural gas and propane. Byproducts of natural gas combustion do not contaminate the food products. One drawback of the combustion of natural gas to generate heat, however, is the accompanying emissions, such as, for example, carbon emissions in the form of carbon monoxide and carbon dioxide, as well as other gases. Moreover, supplying burners with natural gas involves obtaining, transporting, sourcing, and refining steps that require energy, which also results in emissions, such as carbon emissions.

It would, therefore, be advantageous to manufacture a burner for an oven or grill that utilizes a more sustainable and renewable source of energy without sacrificing the quality of the food product, e.g., a fuel other than natural gas for combustion, such as hydrogen gas, which results in reduced emissions, e.g., reduced carbon footprint, upon combustion. Notably, byproducts of hydrogen combustion also do not contaminate food products.

BRIEF SUMMARY OF THE DISCLOSURE

Briefly stated, one aspect of the present disclosure is directed to a hydrogen gas burner including a first, axially extending, tubular pipe having an axial slot in a sidewall thereof. An axially elongate duct projects radially outwardly from the axial slot and is in fluid communication with an interior of the first pipe. The axially elongate duct has a plurality of through-holes formed through a wall thereof, the through-holes fluidly communicating the interior of the first pipe with an exterior thereof. A second, axially extending, tubular pipe, has an axial opening in a sidewall thereof, the axial opening spanning at least a portion of an axial extent of the second pipe. The first pipe is substantially nested within the second pipe and the axially elongate duct projects radially outwardly through the axial opening. A combination gas valve and pressure regulator connects to an inlet of the first pipe, the combination gas valve and pressure regulator being configured to fluidly connect a source of hydrogen gas with the interior of the first pipe, such that the hydrogen gas flows into the first pipe via the inlet thereof. An igniter is configured to provide an electrical spark adjacent at least one of the plurality of through-holes, and, in turn, ignite and initiate combustion of the hydrogen gas exiting from the first pipe and the axially elongate duct via the plurality of through-holes.

In one configuration, the second pipe is configured to fluidly connect with a source of air, whereby air flows into the second pipe and surrounds the first pipe.

In any one of the previous configurations, the axial opening of the second pipe includes a substantially linear base edge surface in substantially continuous contact with a bottom surface of the axially elongate duct.

In any one of the previous configurations, the axial opening of the second pipe includes an upper edge defined by a toothed surface, the toothed surface including a plurality of axially spaced apart teeth dimensioned to contact an upper surface of the axially elongate duct, and each two successive teeth having a recessed channel therebetween. In one configuration, the teeth define a substantially uniform axial length. In any one of the previous configurations, the recessed channels define a substantially uniform axial length. In any one of the previous configurations, the recessed channels define a substantially uniform recessed width. In any one of the previous configurations, the second pipe is configured to fluidly connect at an inlet thereof with a source of air, whereby air flows into the second pipe from the inlet thereof and exits out of the second pipe via the recessed channels.

In any one of the previous configurations, the axially elongate duct includes an axially elongate upper ledge protruding radially outwardly from an upper periphery of the axial slot, an axially elongate lower ledge protruding radially outwardly from a lower periphery of the axial slot, and an axially elongate plate affixed to respective radially outward, terminal ends of the upper ledge and the lower ledge. In one configuration, the plurality of through-holes are formed through the axially elongate plate. In any one of the previous configurations, the upper ledge and the lower ledge are monolithically formed with the first pipe.

In any one of the previous configurations, the hydrogen gas burner further includes an opposite side sensor positioned proximate a distal end of the axially elongate duct, the opposite side sensor being configured to sense the presence of a flame.

In any one of the previous configurations, the axially elongate duct extends from proximate the igniter to a distal end of the first pipe.

In any one of the previous configurations, the axial slot is formed in a lateral side of the sidewall of the first pipe.

In any one of the previous configurations, the axial opening of the second pipe angularly aligns with the axial slot of the first pipe.

In any one of the previous configurations, each of the first and second tubular pipes is a generally hollow cylindrical pipe.

In any one of the previous configurations, at least one of the first pipe or the second pipe is at least partially constructed of mild steel, stainless steel or a combination thereof.

In any one of the previous configurations, at least one of the first pipe or the second pipe is at least partially coated with a high emissivity thermal layer.

In any one of the previous configurations, each of the first pipe and the second pipe defines a respective distal terminal end, and wherein the hydrogen gas burner further includes an end cap closing the distal terminal ends of the first pipe and the second pipe.

In any one of the previous configurations, the hydrogen gas burner further includes a distal end support member distally extending from the end cap and configured to engage an opposing structure to elevationally support the respective distal terminal ends of the first pipe and the second pipe.

In any one of the previous configurations, the plurality of through-holes are arranged along at least one row.

In any one of the previous configurations, the plurality of through-holes are arranged along a single row.

BRIEF DESCRIPTION OF THE SEVERAL VIEWS OF THE DRAWINGS

The following description of the disclosure will be better understood when read in conjunction with the appended drawings. It should be understood, however, that the disclosure is not limited to the precise arrangements and instrumentalities shown. In the drawings.

DETAILED DESCRIPTION OF THE DISCLOSURE

Figure 1:
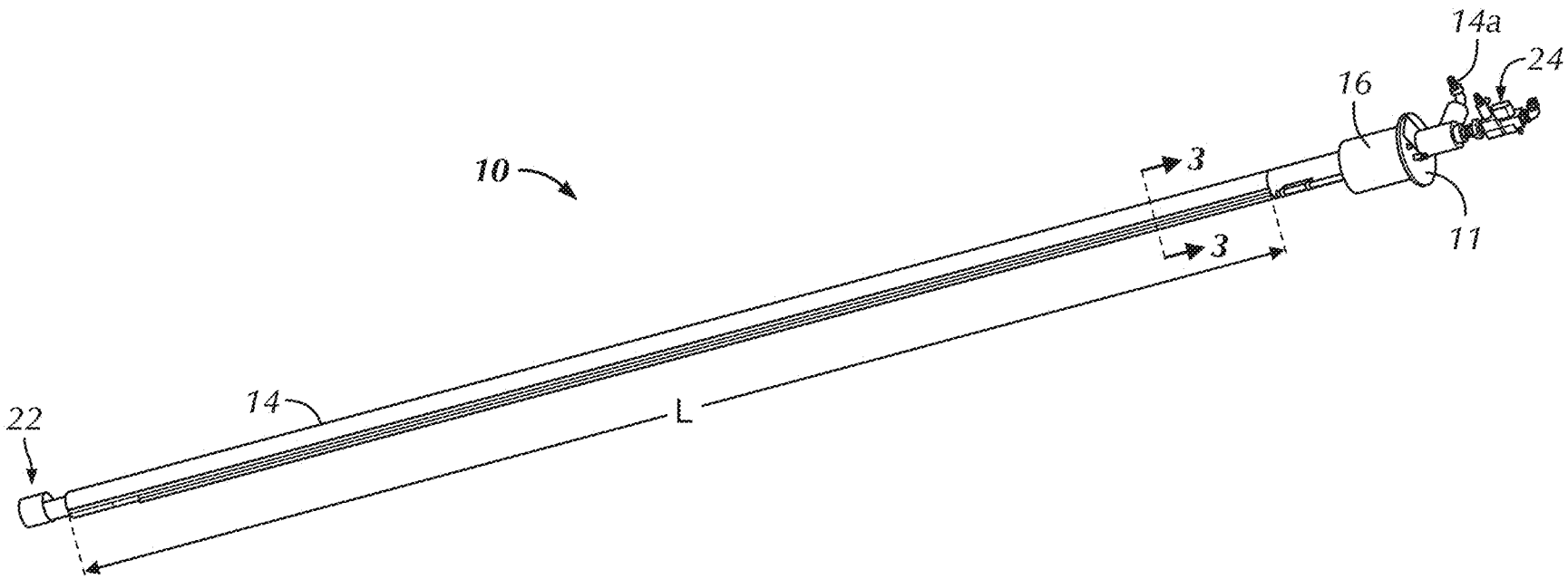
FIG. 1 is a top and front perspective view of a hydrogen gas burner for use with a direct, indirect or hybrid fired oven, according to an embodiment of the present disclosure.

Certain terminology is used in the following description for convenience only and is not limiting. The words "lower," "bottom," "upper" and "top" designate directions in the drawings to which reference is made. The words "inwardly," "outwardly," "upwardly" and "downwardly" refer to directions toward and away from, respectively, the geometric center of the burner, and designated parts thereof, in accordance with the present disclosure. In describing the burner, the terms proximal and distal are used in relation to the burner inlet, proximal being closer to the inlet and distal being further from the inlet. Unless specifically set forth herein, the terms "a," "an" and "the" are not limited to one element, but instead should be read as meaning "at least one." The terminology includes the words noted above, derivatives thereof and words of similar import.

It should also be understood that the terms "about," "approximately," "generally," "substantially" and like terms, used herein when referring to a dimension or characteristic of a component of the disclosure, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Referring to the drawings in detail, wherein like numerals indicate like elements throughout, there is shown in FIGS. 1-11 a burner 10 for use with a direct, indirect or hybrid fired oven, e.g., a commercial/industrial oven or grill, in accordance with an embodiment of the present disclosure. The burner 10 includes a first (or inner) axially extending tubular pipe 12 substantially nested within a second (or outer) axially extending tubular pipe 14. That is, at least a majority of the first tubular pipe 12 axially extends within the second tubular pipe 14. In the illustrated configuration, the first and second tubular pipes 12, 14 are not coaxial, i.e., eccentrically related, but the disclosure is not so limited. That is, the first and second tubular pipes 12, 14 may be substantially concentric with one another. As should be understood, the term "tubular" is not limited to an axially elongate member having a circular cross-section (in a plane perpendicular to the axial length thereof) or to having uniform internal and external cross-sectional peripheral dimensions. Rather the term "tubular" includes axially elongate members having any of non-circular shapes in cross-section, varying internal cross-sectional peripheral dimensions or varying external cross-sectional peripheral dimensions.

In the illustrated configuration, the first and second pipes 12, 14 are generally cylindrical along the axial length thereof, i.e., define a generally circular cross-section in a plane perpendicular to the length thereof, but the disclosure is not so limited. As will be described in further detail below, the second pipe 14 includes a cylindrical sidewall having an axial opening 15 in the sidewall thereof and spanning at least a portion of the axial extent of the second pipe 14. In the illustrated embodiment, the axial opening 15 extends from proximate the igniter 20 (described further below) to igniter 20 extends to proximate the terminal distal end of the second pipe 14, but the disclosure is not so limited. The first pipe 12 includes a cylindrical sidewall portion having an axial slot 12*a* in the sidewall thereof and a parallel, axially elongate bar/duct 18 projecting radially outwardly from the axial slot 12*a* and through the axial opening 15 of the second pipe 14. Alternatively, one or both of the first and second pipes 12, 14 may define a non-circular cross-section, i.e., a prism, such as, for example, without limitation, a square, oval, indented, or square flattened cross-section, a combination thereof along different portions of the length of the pipe(s) or the like. As also should be understood, the first and second pipes 12, 14 may be differently shaped in cross-section from one another. In one configuration, one or both of the first and second pipes 12, 14 may be at least partially constructed of mild steel, stainless steel, a combination thereof or the like. The first and second pipes 12, 14 need not be constructed of the same material. Optionally, one or both of the first and second pipes 12, 14 may be at least partially coated with a high emissivity thermal layer, e.g., a nano-emissive coating, such as, for example, as disclosed in U.S. Pat. No. 8,840,942, the entire contents of which are incorporated by reference herein.

The first and second pipes 12, 14 are secured relative to one another and relative to an oven chamber 1 (shown schematically in FIG. 2) of a direct, indirect or hybrid fired oven (not shown) via a mounting spool pipe 16 proximate a proximal end of the pipes 12 and 14. The mounting spool pipe 16 extends through, and is secured to, the oven chamber wall 1*a* in a manner well understood by those of ordinary skill in the art. That is, the length of the mounting spool pipe 16 generally corresponds to the thickness of the oven chamber wall 1*a* and at least one flanged end 16*a* of the mounting spool pipe 16 is secured, e.g., fastened, to the wall 1*a*. The mounting spool pipe 16 is generally hollow for the first and second pipes 12, 14 to extend therethrough. In one configuration, the second pipe 14 includes a burner flange 11 radially projecting from the second pipe 14, and which is fastened to the flanged end 16*a* of the mounting spool pipe 16. As should be understood, however, the first and second pipes 12, 14 may be secured relative to one another and to the mounting spool pipe 16 via other methods currently known or that later become known.

Figure 9:
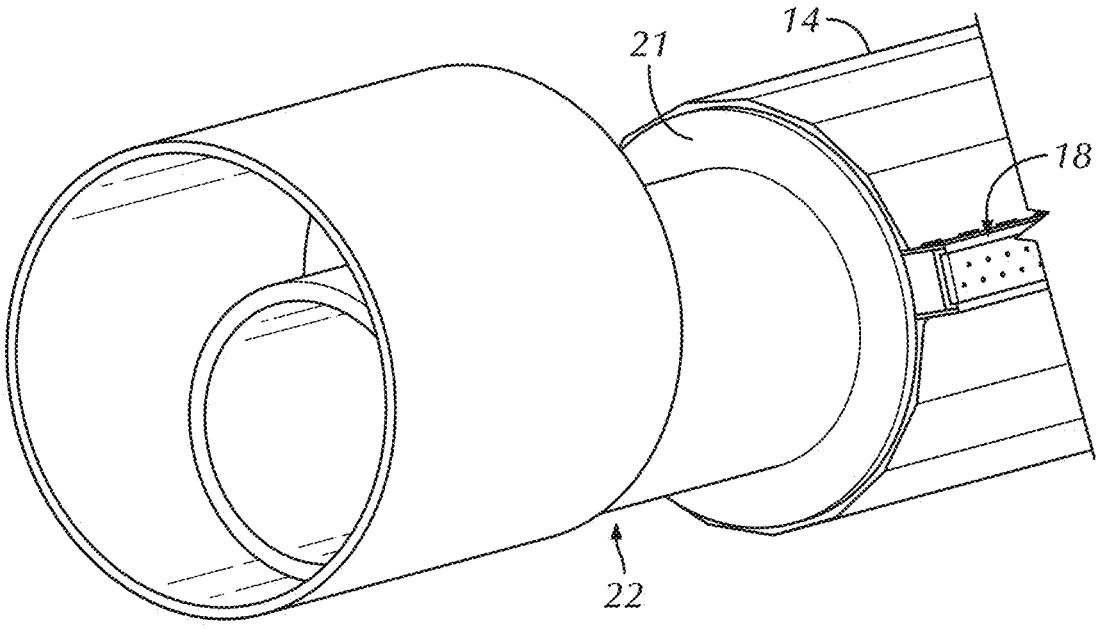
FIG. 9 is a partial, front and distal perspective view of a distal end of the burner of FIG. 1.
Figure 10:
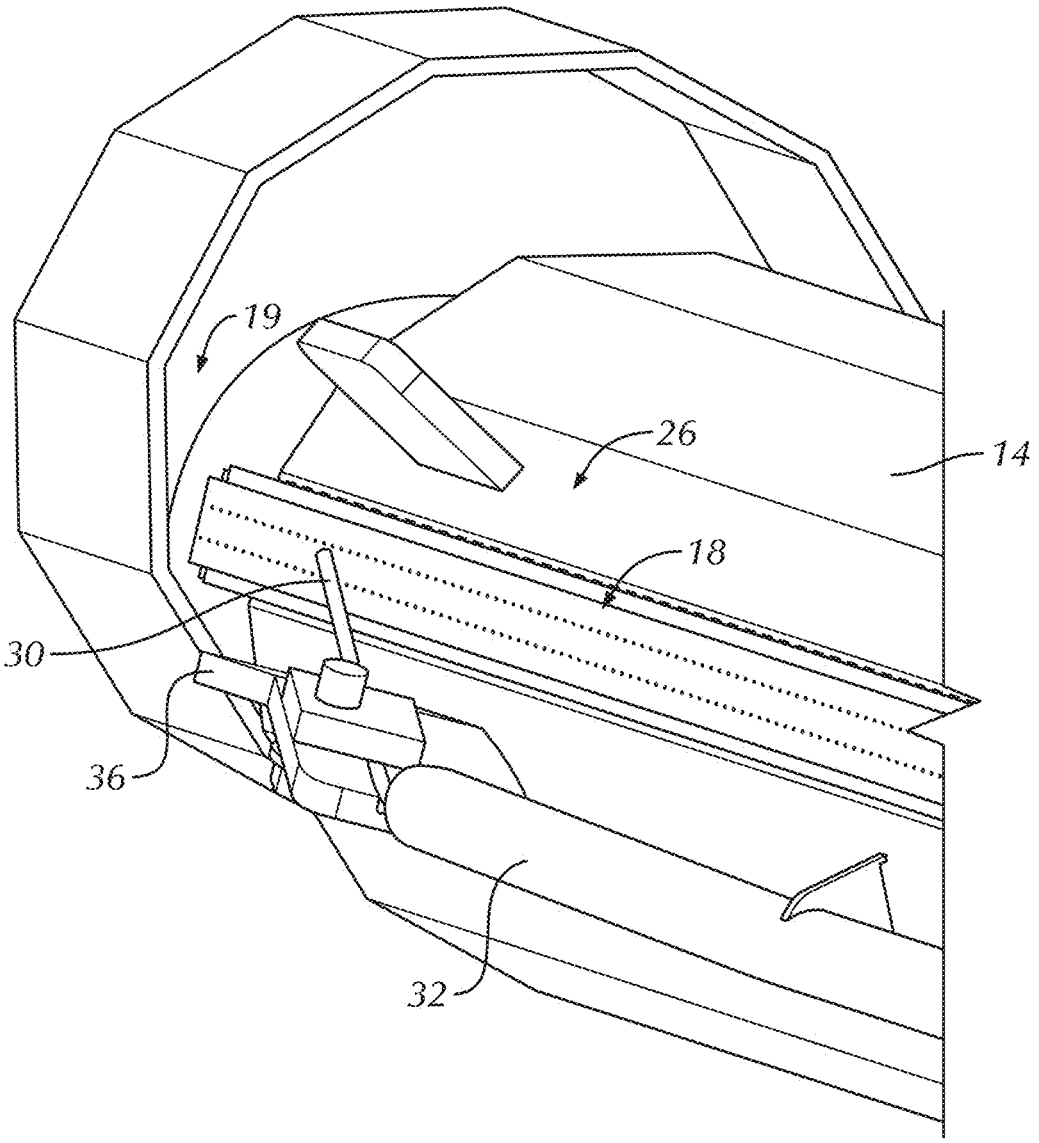
FIG. 10 is a partial, front and distal perspective view of a distal end of the burner of FIG. 1.
Figure 11:
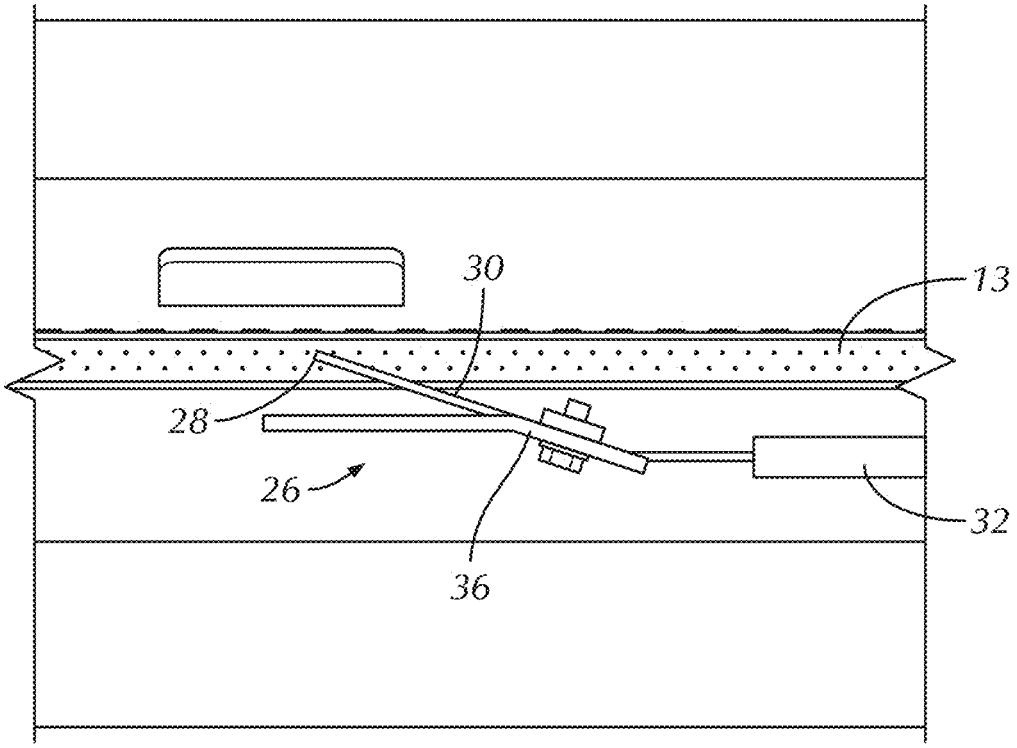
FIG. 11 is a partial, front elevational view of a distal portion of the burner of FIG. 1.

Turning to the distal end of the burner 10, as shown best in FIG. 9, the first and second pipes 12, 14 are closed (e.g., covered) at the respective distal ends thereof by an end cap 21. The burner 10 further includes a distal end support member 22 distally extending from the end cap 21 to engage an opposing wall, e.g., distal end, (not shown) of the oven 1 and to elevationally support the distal end of the first and second pipes 12, 14. Additionally or alternatively, the burner 10 may includes other support mechanisms, currently known or that later become known, such as, for example, without limitation, at least one of legs or hangers protruding therefrom (anywhere along the axial length thereof) and elevationally supporting the burner 10 within the oven 1.

Figure 3:
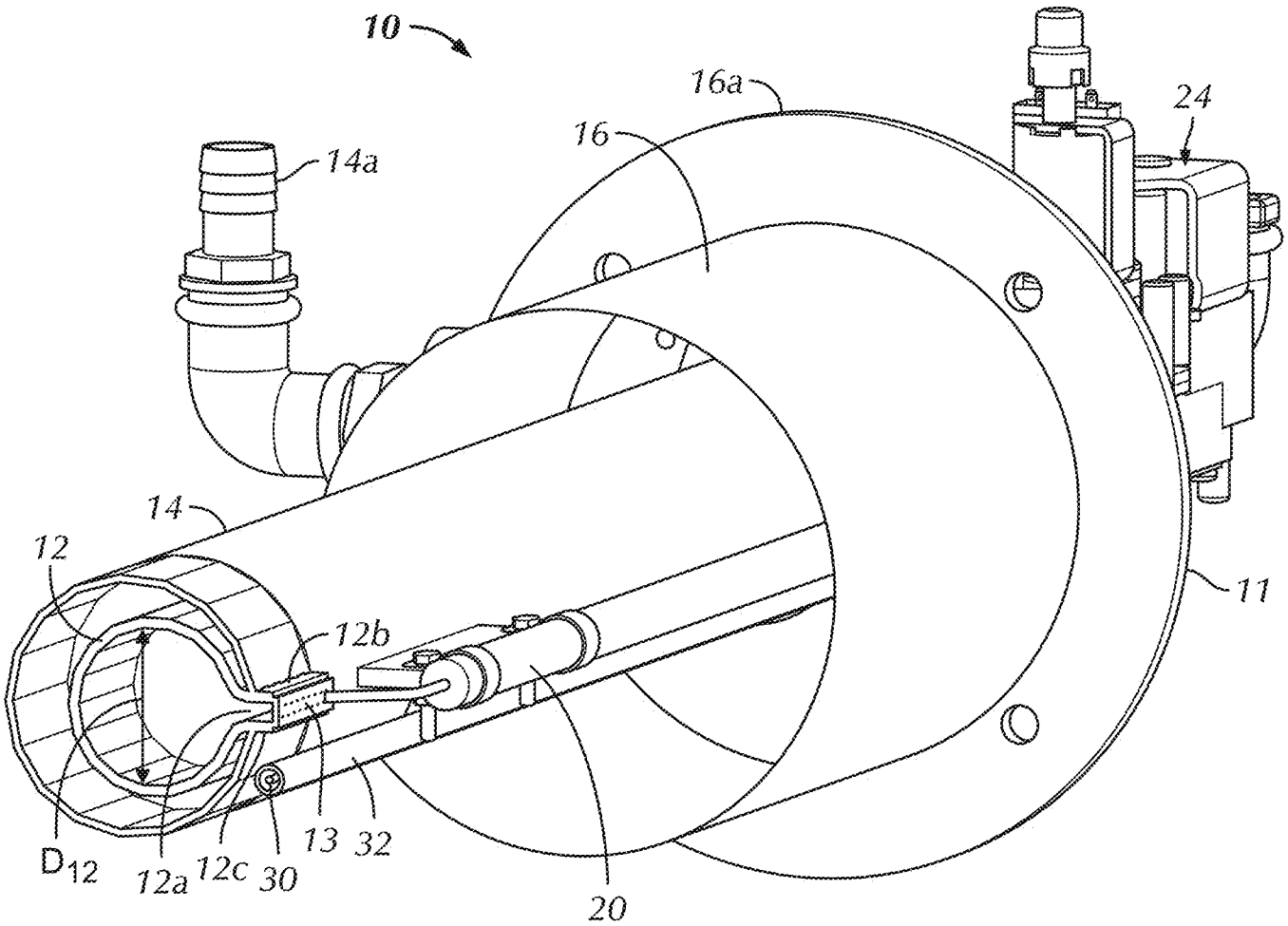
FIG. 3 is a cross-sectional perspective view of the burner of FIG. 1, taken along sectional line 3-3 of FIG. 1
Figure 4:
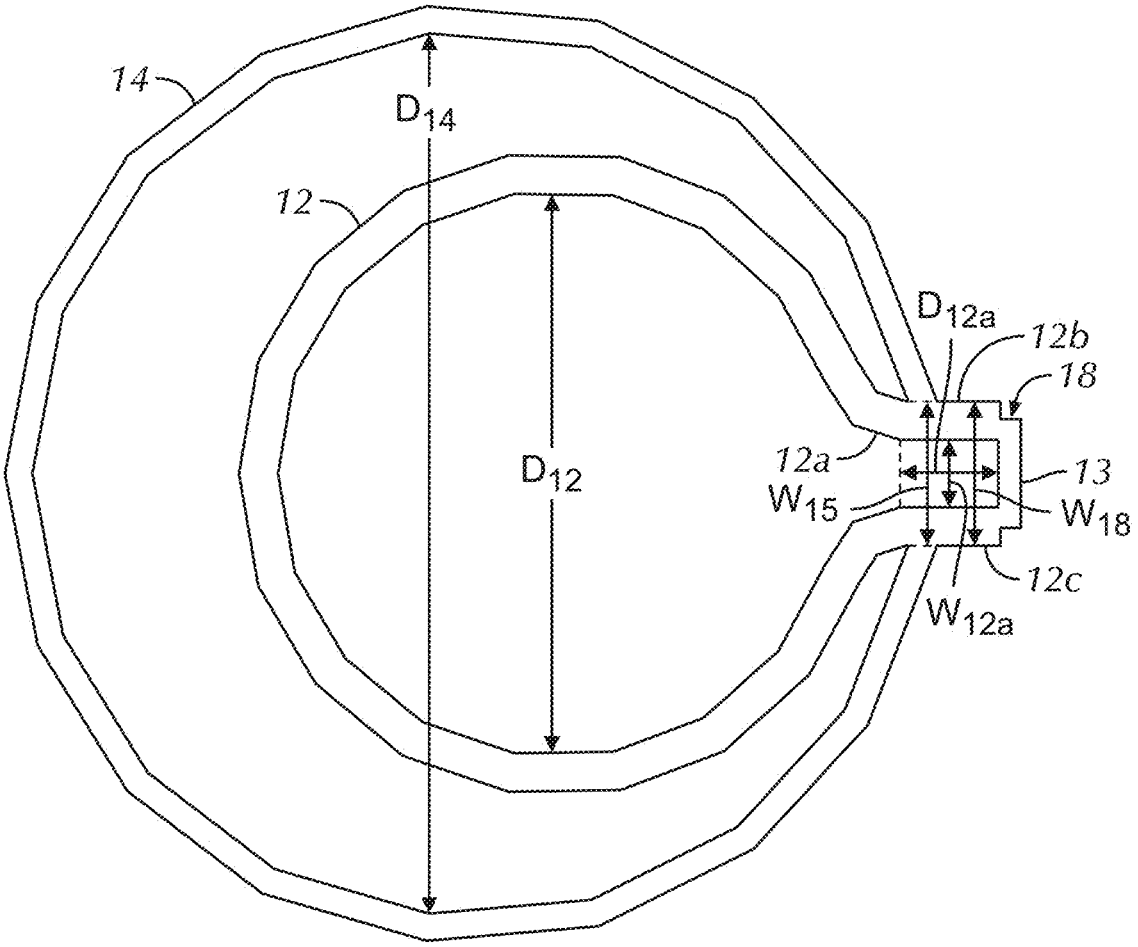
FIG. 4 is a cross-sectional view of the first and second pipes of burner of FIG. 1, taken along sectional line 4-4 of FIG. 2.
Figure 6:
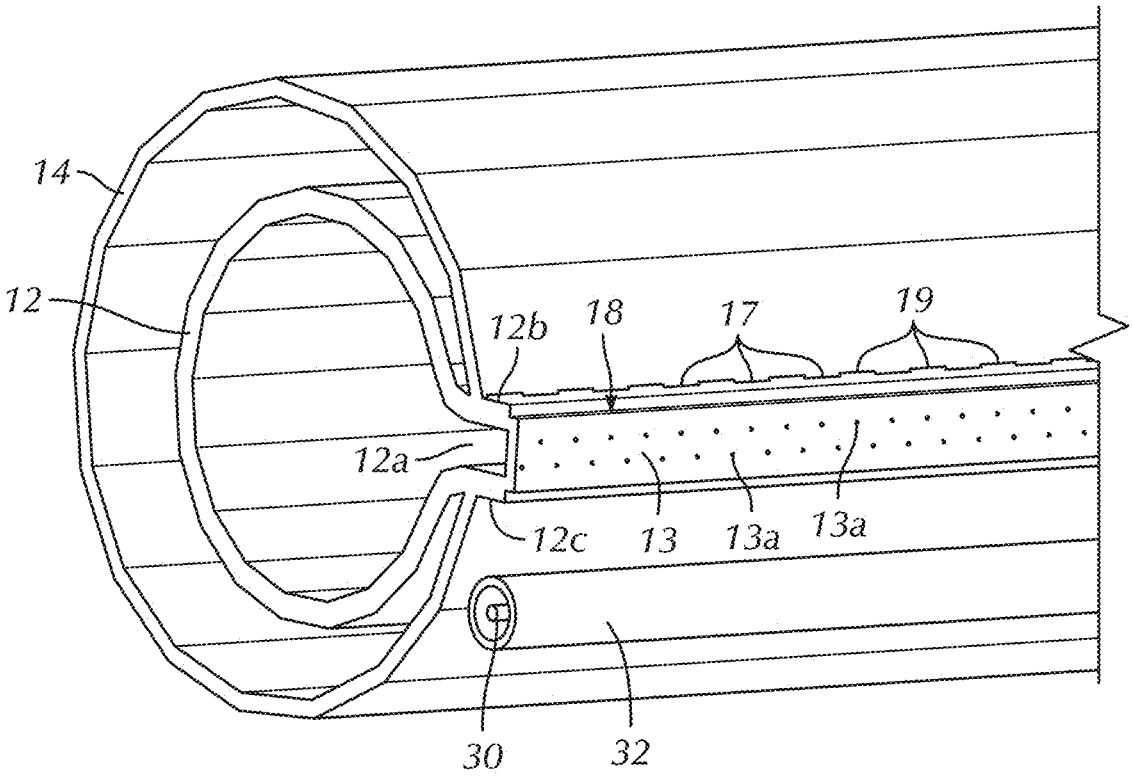
FIG. 6 is an enlarged, partial perspective view of the burner of FIG. 1.

As shown best in FIGS. 3, 4 and 6, the first pipe 12 includes the axially elongate slot 12*a* formed in a lateral side of the sidewall of the first pipe 12. The axially elongate duct 18 projecting radially outwardly from the axially elongate slot 12*a* includes a pair of spaced apart, parallel and axially elongate ledges 12*b*, 12*c* (upper and lower) extending radially outwardly from the upper and lower peripheries of the slot 12*a*. That is, an elongate upper ledge 12*b* protrudes radially outwardly from the upper boundary of the slot 12*a* and an elongate lower ledge 12*c* protrudes radially outwardly from the lower boundary of the slot 12*a*. In the illustrated embodiment, the axially elongate ledges 12*b*, 12*c* are horizontally oriented, but the disclosure is not so limited. In the illustrated embodiment, the axially elongate ledges 12*b*, 12*c* are monolithically formed with the cylindrical portion of the sidewall of the first pipe 12, but the disclosure is not so limited. An axially elongate plate 13 is affixed, e.g., welded, to the free (cantilevered) terminal ends of the upper and lower elongate ledges 12*b*, 12*c* to cover the slot/channel therebetween. In one configuration, the plate 13 may be constructed of stainless steel, mild steel or the like. In the illustrated embodiment, the elongate plate 13 is vertically oriented between the horizontal ledges 12*b*, 12*c*, but the disclosure is not so limited. Together, the upper and lower elongate ledges 12*b*, 12*c* and the elongate plate 13 form the radially outwardly protruding, axially elongate duct 18 as a portion of the sidewall of the first pipe 12 and in fluid communication with the interior of the first pipe 12. In one configuration, the duct 18 defines an inner width $W_{12a}$ of between approximately 5 mm (0.196 inch) and approximately 15 mm (0.590 inch). In one configuration, the duct 18 defines a depth $D_{12a}$ of between approximately 7.5 mm (0.296 inch) and approximately 12.5 mm (0.492 inch).

Figure 5:
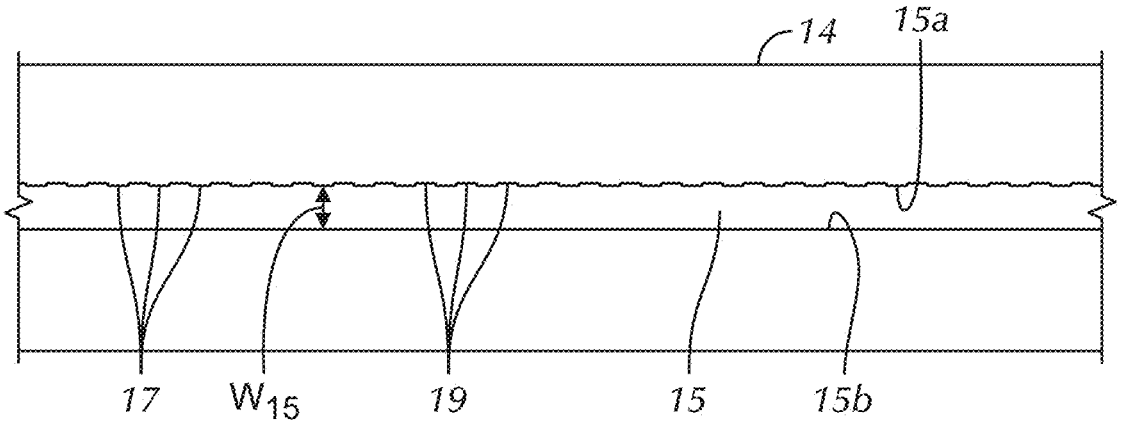
FIG. 5 is an enlarged, partial front elevational view of the second pipe of the burner of FIG. 1.

Turning to the second pipe 14, the second pipe 14 also includes the axially elongate opening 15 formed in a lateral side of the sidewall thereof (FIGS. 3, 5, 6). The opening 15 of the second pipe 14 is angularly positioned along the periphery of the second pipe 14 to angularly align with and/or overlay the angular location of the slot 12*a* of the first pipe 12. The opening 15 is substantially complementary in width $W_{15}$ (in a plane perpendicular to the axial length of the pipe 14) to an outer width $W_{18}$ of the duct 18. As shown best in FIGS. 5 and 6, the base edge 15*b* of the opening 15 is substantially linear and in substantially continuous attachment, e.g., via welding, with the bottom ledge 12*c* of the duct 18. Conversely, in the illustrated embodiment, the upper edge 15*a* of the opening 15 takes the form of a toothed surface, defined by a plurality of axially spaced apart teeth 17 dimensioned to attach to, e.g., via welding, the upper ledge 12*b* of the duct 18, and defining recessed channels 19 between successive teeth 17, thereby forming axially spaced apertures with the upper ledge 12*b* of the duct 18. In the illustrated configuration, the teeth 17 are generally rectangular (with or without rounded corners), but the disclosure is not so limited. For example, without limitation, the teeth 17 may be tapered, beveled, a combination thereof, or the like. Alternatively, the upper edge 15*a* of the opening 15 may also be substantially linear, i.e., similar to the base edge 15*b*, in substantially continuous attachment with the upper ledge 12*b* of the duct 18, and define a plurality of axially spaced apart thru-holes (not shown) proximate the upper edge 15*a*.

In the illustrated configuration, the teeth 17 define a generally uniform length $L_{17}$ along the axial extent of the second pipe 14. The channels/apertures 19 may also define a generally uniform length $L_{19}$. The disclosure is not so limited, however, and the lengths $L_{17}$ and $L_{19}$ may be non-uniform. For example, without limitation, length $L_{17}$ may progressively decrease along the axial extent of the second pipe 14 and the length $L_{19}$ may progressively increase. In one configuration, the length $L_{17}$ may be between approximately 3 mm (0.12 inch) and approximately 10 mm (0.39 inch), such as, for example, approximately 5 mm (0.20 inch). In one configuration, the length $L_{19}$ may be between approximately 3 mm (0.12 inch) and approximately 10 mm (0.39 inch), such as, for example, approximately 5 mm (0.20 inch). In one configuration, the channels/apertures 19 define a recessed width $W_{19}$ of between approximately 0.1 mm (0.004 inch) and approximately 0.5 mm (0.02 inch), such as, for example, approximately 0.3 mm (0.01 inch). The dimensions of the channels 19 (and, in turn, that of the teeth 17) are sized to permit a sufficient amount of air to exit therethrough, as described in further detail below. As should be understood, the width $W_{15}$ of the opening 15 is measured along, i.e., at the portions of the opening 15 having, the teeth 17.

In one embodiment, as shown in FIG. 1, the first and second pipes 12, 14 define substantially equal axial lengths, but the disclosure is not so limited. The length of the first and second pipes 12, 14 is dimensioned according to the size of the oven 1. The axial length of the duct 18 defines the functional or operative length L of the first pipe 12. In the illustrated embodiment, the duct 18 axially extends from proximate the igniter 20 to the distal end of the first pipe 12, but the disclosure is not so limited. In one embodiment, the functional length L is between approximately 500 mm (19.6 inches) and approximately 6,100 mm (240 inches), but the disclosure is not so limited. In one embodiment, the first pipe 12 defines an internal diameter D12 (FIG. 4) of between approximately 12 mm (0.5-inch IPS, i.e., iron pipe size indicating inside diameter) and approximately 76.2 mm (3.0-inches IPS). In one embodiment, the second pipe 14 defines an internal diameter D14 (FIG. 4) of between approximately 40 mm (1.5-inch IPS) and approximately 115 mm (4.5-inch IPS).

The first pipe 12 includes a plurality of apertures/through-holes 13*a* along the elongate plate 13 of the duct 18, e.g., laser or EDM cut, drilled or the like (shown best in FIGS. 3, 6, 7), positioned along a portion of the axial length thereof, defining the flame space of the first pipe 12. In the illustrated embodiment, the apertures 13*a* are generally circular but the disclosure is not so limited. As should be understood, the apertures 13*a* may take other shapes/geometries. The plurality of apertures 13*a* are arranged in at least one row of apertures 13*a* positioned in series along a portion of the length L of the first pipe 12. For example, more than one row of apertures 13*a* may be employed for increased thermal output of the burner 10. In the illustrated embodiment, two rows of the apertures 13*a* (FIGS. 3, 6 and 7) are employed, but the disclosure is not so limited. For example, three, four or more rows of apertures 13*a* may be employed. In one configuration, the apertures 13*a* positioned in series forming one row may be axially offset, i.e., along the length of the first pipe 12, from the apertures 13*a* positioned in series forming another row. For example, in the illustrated embodiment (FIGS. 3, 6, 7), the apertures 13*a* of one row may each be positioned between two successive apertures 13*a* of the adjacent row(s). Alternatively, the apertures 13*a* may be arranged in series in a single row of apertures 13*a*. As should be understood by those of ordinary skill in the art, the plate 13 may alternatively be substituted with a porous material of suitable porosity.

Figure 7:
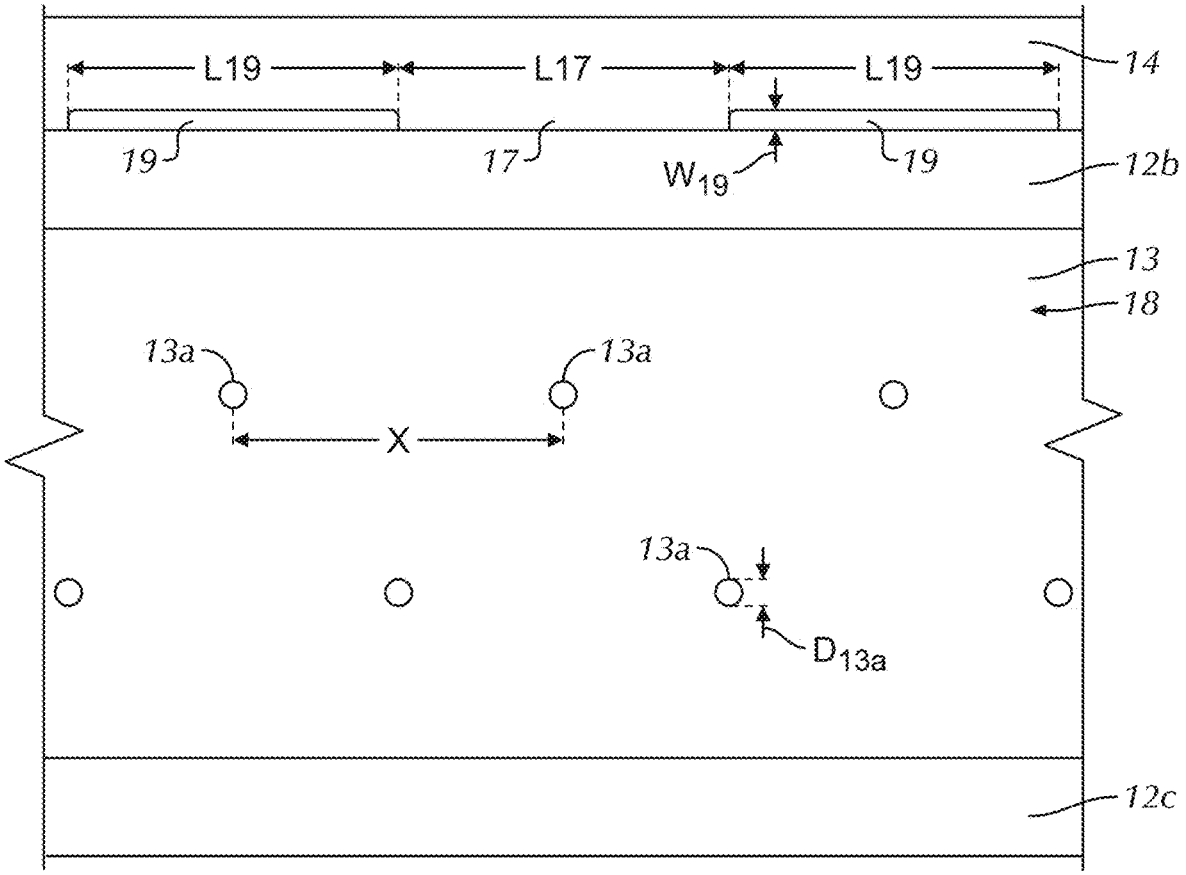
FIG. 7 is an enlarged, partial front elevational view of the burner of FIG. 1.

Referring now to FIG. 7, each pair of successive apertures 13*a* along a row is spaced a distance X apart on-center. In the illustrated embodiment, the distance X is substantially uniform along the axial length of the plate 13, but the disclosure is not so limited. For example, without limitation, the spacing X may decrease along the axial length of the plate 13, resulting in the apertures 13*a* getting progressively closer to one another along the axial length of the plate 13. In one configuration, the distance X may be between approximately 3 mm (0.12 inch) and approximately 9 mm (0.35 inch), such as, for example, without limitation, approximately 5 mm (0.2 inch), but the disclosure is not so limited. In one embodiment, each aperture 13*a* defines an internal diameter $D_{13a}$ between approximately 0.02 mm (0.008 inch) and approximately 0.76 mm (0.03 inch), such as, for example, without limitation, approximately 0.4 mm (0.016 inch), but the disclosure is not so limited. As should be understood by those of ordinary skill in the art, the operative length L of the first pipe 12, the internal diameter D12 of the first pipe, the spacing X between the apertures 13*a*, the internal diameter $D_{13a}$ of the apertures 13*a*, and the size of the oven chamber 1, or a combination thereof, determines the thermal output of the burner 10. In one configuration, the burner 10 is configured to produce between approximately 2.0 kW/m (150 Btu/in) and approximately 28.8 kW/m (2,500 Btu/in) of heat.

Figure 2:
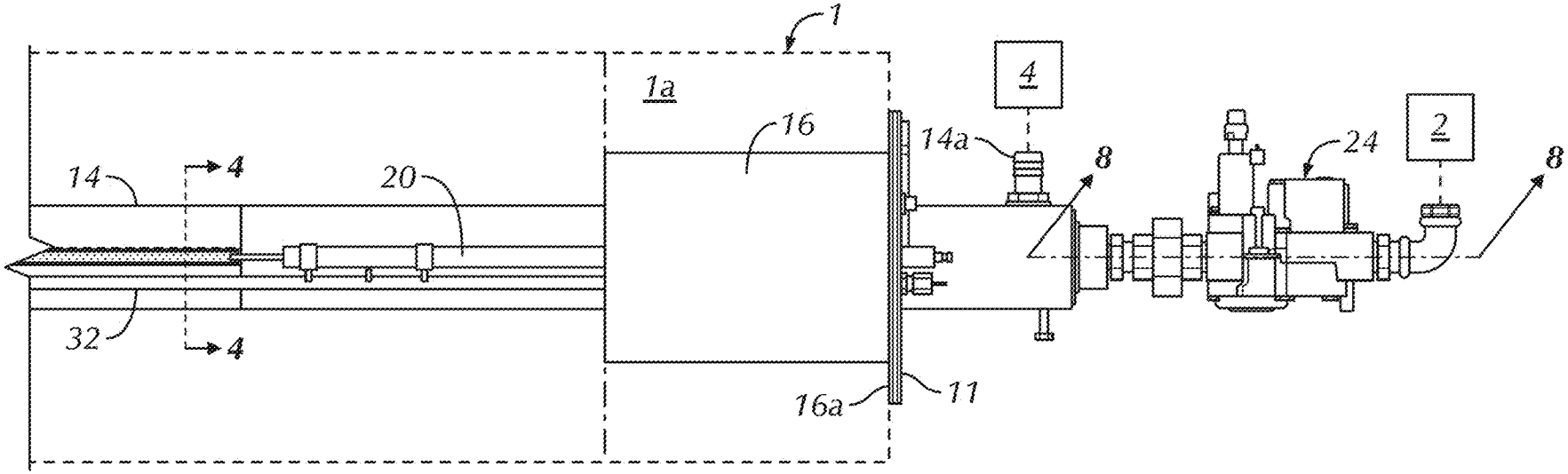
FIG. 2 is an enlarged, partial front elevational view of the burner of FIG. 1.

As shown best in FIGS. 2 and 3, the burner 10 further includes an igniter 20 (controlled via a direct spark ignition (not shown)) connected to, or mounted adjacent to, the first duct 18 in a manner well understood by those of ordinary skill in the art and configured to provide an electrical spark adjacent one or more of the apertures 13*a* along the duct 18. As shown, the igniter 20 extends substantially parallel to the first and second pipes 12, 14 and is positioned proximate a proximal end of the first and second pipes 12, 14. Similarly to the first and second pipes 12, 14, the igniter 20 may extend through the mounting spool pipe 16 and may be secured by the mounting plates, but the disclosure is not so limited. As should be understood by those of ordinary skill in the art, the igniter 20 may take the form of a conventional combination igniter and flame detection sensor.

As also shown in FIGS. 1-3, a combination gas valve (double valved) and pressure regulator 24, e.g., without limitation, a Honeywell Resideo model number VK4105M5215 U gas control with a gas regulator, is connected to an inlet, e.g., at a proximal end, of the first pipe 12. As should be understood by those of ordinary skill in the art, the combination gas valve and pressure regulator 24 selectively fluidly connects a source of combustion fuel/gas 2 (shown schematically in FIG. 2) flowing from a main gas manifold (not shown) with the inlet of the first pipe 12. In the present disclosure, the combustion fuel/gas utilized with the first pipe 12 is hydrogen gas. In one configuration, the combination gas valve and pressure regulator 24 is configured to regulate the hydrogen gas flowing into the first pipe 12 to a pressure between approximately 5 mbar (2" wc, i.e., inches of water column) and approximately 60 mbar (24" wc).

Figure 8:
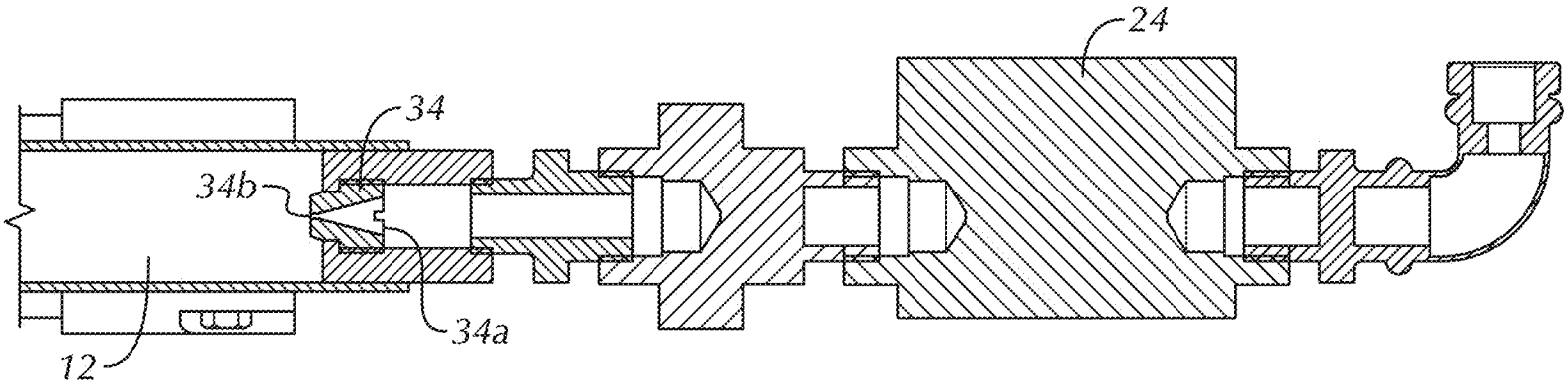
FIG. 8 is a partial, cross-sectional elevational view of the burner of FIG. 1, taken along the sectional line 8-8 of FIG. 2.

In one configuration, as shown in FIG. 8, a combustion gas-flow nozzle 34, is fluidly interposed between the combination gas valve and pressure regulator 24 and the first pipe 12 to set the maximum amount of combustion gas entering the first pipe 12. In the illustrated embodiment, the nozzle 34 is sealingly positioned within a proximal end of the first pipe 12. As shown, the nozzle 34 defines an inlet opening 34*a* and an outlet opening 34*b* (according to the direction of flow into the first pipe 12). In the illustrated embodiment, the inner diameter of the combustion gas-flow nozzle 34 generally tapers from a wider inlet opening 34*a* to a narrower outlet opening 34*b*. The diameter of the outlet opening 34*b* is selected relative to the maximum amount of combustion gas required in the first pipe 12 to achieve the intended thermal output of the burner 10. As should be understood by those of ordinary skill in the art, the calibrated diameter of the outlet opening 34*b*, in combination with the pressure of the combustion gas, determines the flow rate of the combustion gas entering the first pipe 12, i.e., according to Bernoulli's equation. In one configuration, the outlet opening 34*b* of the nozzle 34 may define a diameter between approximately 0.019 inch (0.5 mm) and approximately 0.393 inch (10 mm) depending on the maximum flow rate for the particular length of the first pipe 12, such as, for example, without limitation, approximately 0.07 inch (1.8 mm).

In operation, the valves (not shown), e.g., solenoid valves, within the combination gas valve and pressure regulator 24 are opened to allow the flow of hydrogen gas from the hydrogen gas source 2 into the first pipe 12 and the pressure regulator (not shown) within the combination gas valve and pressure regulator 24 regulates the pressure of the hydrogen gas within the first pipe 12. The nozzle 34 sets the maximum flow rate of the hydrogen gas into the first pipe 12. The hydrogen gas then flows out of the apertures 13*a*. The igniter 20 is then actuated to provide an electrical spark which ignites the flame along the apertures 13*a* and initiates combustion of the hydrogen gas exiting from the apertures 13*a*. As should be understood, the hydrogen gas combusting, i.e., burning, in the air within the oven chamber 1 reacts with the oxygen in the air to form moisture, i.e., water vapor, and thermal energy.

Advantageously, hydrogen gas combustion byproducts are free of carbon, and, therefore, carbon emissions are significantly minimized. Additionally, water vapor byproduct of hydrogen gas combustion far exceeds that of natural gas combustion. The relative increase in moisture content within the oven chamber 1, in a controlled manner, may aid in a baking process, such as, for example, with baking of grain-based products, e.g., bread, buns, rolls, bagels, pretzels and the like. For example, the increase of moisture content may aid in more efficient heat transfer to the grain-based product, thereby reducing baking time. The increase in moisture content also enables heat to reach the inside of the product sooner, advancing functions such as yeast kill, gelatinization, and arrival time, i.e., dough becomes bread sooner. The moisture may subsequently be extracted (in a manner well understood by those of ordinary skill in the art) at a specific point in the baking process to allow for other objectives, such as product color and crust, to develop.

Accordingly, the burner 10 advantageously utilizes a more sustainable source of energy while also producing at least the same or better-quality products.

The second pipe 14 may be connected to an air-only source 4 (shown schematically in FIG. 2) via an inlet port 14*a* proximate a proximal end of the second pipe 14. In operation, the air travels into the second pipe 14 and exits out of the recessed channels 19 in the form of concentrated streams of air upon the duct 18 and over the flame and into the oven 1. In one configuration, the second pipe 14 may release between approximately 2.37 $m^3$/hr (83.6 $ft^3$/hr) and approximately 42.04 $m^3$/hr (1,484 $ft^3$/hr) of excess air into the oven chamber 1. The second pipe 14, releasing only air (via recessed channels 19), may be employed to assist in reduction of nitrogen oxides. That is, the second pipe 14 may release air to substantially shroud the duct 18. Nitrogen oxides are generally produced from the reaction of nitrogen and oxygen gases in the air during combustion, especially at high temperatures. In operation of the burner 10, release of air from the second pipe 14 above the duct 18 may assist in cooling the flame outside the apertures 13*a* (the flame naturally having an upward trajectory as heat rises), thereby reducing nitrogen oxide formation. Release of air from the second pipe 14 may also assist with the hydrogen gas combustion process, e.g., maintaining an appropriate volume of air within the oven chamber 1.

Advantageously, the duct 18 strengthens the structural rigidity of the first pipe 12 against bending of the pipe 12 in response to the heat generated by the burner 10. Further advantageously, engagement of the second pipe 14 with the duct 18 (as previously described) further increases the structural rigidity of the first pipe 12. The air within the second pipe 14, surrounding the first pipe 12, also operates as a coolant to the first pipe 12 to also assist in mitigating against heat induced pipe 12 deflection or other deformation. High emissivity thermally protective coating of the second pipe 14 also assists in emitting heat away from the second pipe 14, thereby preserving the cooling effect of the air within.

An opposite side sensor 26 may be positioned proximate the distal end of the duct 18 of the first pipe 12 to sense the presence of a flame, and operatively connected to the direct spark ignition control module (not shown) of the burner 10. In one configuration, the opposite side sensor 26 takes the form of at least one temperature measuring, thermocouple 28 (e.g., type J or K thermocouple) positioned in the flame space of the distal end of the duct 18. The thermocouple(s) 28 is positioned inside a distal end of the wire 30, which axially extends proximate the second pipe 14. As shown best in FIGS. 2, 3, 10 and 11, the wire 30 axially extends through a tube 32 affixed to the second pipe 14 and the wire 30 projects out of a distal end of the tube 32 proximate the distal end of the duct 18. A bracket 36 is affixed, e.g., welded, to the distal end of the second pipe 14 and configured to secure, e.g., via a clamp or the like, the distal end of the wire 30 (and the thermocouple(s) 28 therein) in the flame space of the duct 18. As should be understood, however, other forms of opposite sensing, currently known or that later become known, may alternatively be employed.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the present description, as set forth in the appended claims.

We claim:

1. A hydrogen gas burner comprising:

a first, axially extending, tubular pipe having an axial slot in a sidewall thereof;

an axially elongate duct having an axially elongate upper ledge protruding radially outwardly from an upper periphery of the axial slot, an axially elongate lower ledge protruding radially outwardly from a lower periphery of the axial slot, and an axially elongate plate affixed to respective radially outward, terminal ends of the upper ledge and the lower ledge, the axially elongate duct being in fluid communication with an interior of the first pipe and the axially elongate plate having a plurality of through-holes formed therethrough, the through-holes fluidly communicating the interior of the first pipe with an exterior thereof;

a second, axially extending, tubular pipe, having an axial opening in a sidewall thereof, the axial opening spanning at least a portion of an axial extent of the second pipe, the first pipe being substantially nested within the second pipe and the axially elongate duct projecting radially outwardly through the axial opening, the axial opening including a substantially linear base edge surface in substantially continuous contact with the lower ledge of the axially elongate duct;

a combination gas valve and pressure regulator connected to an inlet of the first pipe, the combination gas valve and pressure regulator being configured to fluidly connect a source of hydrogen gas with the interior of the first pipe, such that the hydrogen gas flows into the first pipe via the inlet thereof; and an igniter configured to provide an electrical spark adjacent at least one of the plurality of through-holes, and, in turn, ignite and initiate combustion of the hydrogen gas exiting from the first pipe and the axially elongate duct via the plurality of through-holes.

2. The hydrogen gas burner of claim 1, wherein the second pipe is configured to fluidly connect with a source of air, whereby air flows into the second pipe and surrounds the first pipe.

3. The hydrogen gas burner of claim 1, wherein the axial opening of the second pipe includes an upper edge defined by a toothed surface, the toothed surface including a plurality of axially spaced apart teeth dimensioned to contact the upper ledge of the axially elongate duct, and each two successive teeth having a recessed channel therebetween.

4. The hydrogen gas burner of claim 3, wherein the teeth define a substantially uniform axial length.

5. The hydrogen gas burner of claim 3, wherein the recessed channels define a substantially uniform axial length.

6. The hydrogen gas burner of claim 3, wherein the recessed channels define a substantially uniform recessed width.

7. The hydrogen gas burner of claim 3, wherein the second pipe is configured to fluidly connect at an inlet thereof with a source of air, whereby air flows into the second pipe from the inlet thereof and exits out of the second pipe via the recessed channels.

8. The hydrogen gas burner of claim 1, wherein the upper ledge and the lower ledge are monolithically formed with the first pipe.

9. The hydrogen gas burner of claim 1, further comprising an opposite side sensor positioned proximate a distal end of the axially elongate duct, the opposite side sensor being configured to sense the presence of a flame.

10. The hydrogen gas burner of claim 1, wherein the axially elongate duct extends from proximate the igniter to a distal end of the first pipe.

11. The hydrogen gas burner of claim 1, wherein the axial opening of the second pipe angularly aligns with the axial slot of the first pipe.

12. The hydrogen gas burner of claim 1, wherein each of the first and second tubular pipes is a generally hollow cylindrical pipe.

13. The hydrogen gas burner of claim 1, wherein at least one of the first pipe or the second pipe is at least partially constructed of mild steel, stainless steel or a combination thereof.

14. The hydrogen gas burner of claim 1, wherein each of the first pipe and the second pipe defines a respective distal terminal end, and wherein the hydrogen gas burner further comprises an end cap closing the distal terminal ends of the first pipe and the second pipe.

15. The hydrogen gas burner of claim 14, further comprising a distal end support member distally extending from the end cap and configured to engage an opposing structure to elevationally support the respective distal terminal ends of the first pipe and the second pipe.

16. The hydrogen gas burner of claim 1, wherein the plurality of through-holes are arranged along at least one row.

17. The hydrogen gas burner of claim 1, wherein the axially elongate plate is a planar plate.

* * * * *